US005605030A

United States Patent [19]

Rodocker

[11] Patent Number: 5,605,030

[45] Date of Patent: Feb. 25, 1997

[54] CARTON END CLOSURE SCORE LINE PRE-BREAKING METHOD AND MECHANISM

[75] Inventor: Frank A. Rodocker, Milford, Mich.

[73] Assignee: Elopak Systems AG, Glattbrugg, Switzerland

[21] Appl. No.: 445,369

[22] Filed: May 19, 1995

[51] Int. Cl.[6] ..... B65B 7/16

[52] U.S. Cl. ..... 53/484; 53/565; 53/370.6; 53/373.6; 53/491; 493/310; 493/409

[58] Field of Search ..... 53/565, 376.4, 53/373.6, 370.6, 484, 486, 491; 493/184, 162, 452, 465, 408, 409, 310

[56] References Cited

U.S. PATENT DOCUMENTS

| | | | |
|---|---|---|---|
| 2,218,057 | 10/1940 | Spake | 493/408 |
| 2,224,656 | 12/1940 | Robinson | 493/409 |
| 2,410,587 | 11/1946 | Monroe | 93/36.8 |
| 3,120,089 | 2/1964 | Monroe et al. | 53/565 |
| 3,239,995 | 3/1966 | Monroe et al. | 53/375 |
| 3,249,025 | 5/1966 | Monroe et al. | 93/44.1 |
| 3,820,303 | 6/1974 | Martensson et al. | 53/186 |
| 4,044,656 | 8/1977 | Vetten | 93/44.1 |
| 4,072,089 | 2/1978 | Bosche | 493/164 |
| 4,820,253 | 4/1989 | Mercurio | 493/184 |

*Primary Examiner*—John Sipos
*Assistant Examiner*—Gene L. Kim
*Attorney, Agent, or Firm*—Reising, Ethington, Barnard & Perry PLLC

[57] ABSTRACT

A carton end closure score line breaker mechanism for pre-breaking the top closure score lines before the filling and closing and sealing steps does not include a center post, or any components which extend into the inside of a carton end closure, eliminating any chance for contamination inside the end panels. The center-free breaker mechanism includes a pair of blades each having an arcuate center section for caving in the adjacent end panel and, thereby, bulging the side end panels and pulling in the oppositely disposed panel, and a blade fork and another pair of blades, wherein the blade fork includes two longitudinal, parallel blades which slide across the side body panels, and each blade of the other pair is a flat-faced bar for engaging the adjacent end panel and causing the side end panels to project outwardly completing the pre-breaking of all end closure score lines.

19 Claims, 3 Drawing Sheets

CARTON END CLOSURE SCORE LINE PRE-BREAKING METHOD AND MECHANISM

FIELD OF THE INVENTION

This invention relates generally to carton end closure score line pre-breaking methods and mechanisms, more particularly to center-post-free end closure score line pre-breaker mechanisms, usable in carton forming, filling, and sealing machines.

BACKGROUND ART

Heretofore, end closure score line pre-breaker mechanisms have included components which extend into the open top, for example, the pre-breakers included in the carton forming, filling, and sealing machines disclosed in U.S. Pat. Nos. 3,239,995; 3,249,025; 3,820,303; and 4,044,656.

It is conventional in such machines for flat, sleeve-form carton blanks to be opened into rectangular sleeve form and the sleeves loaded in turn onto mandrels of a rotary, indexing turret. While on the mandrels, bottom end closures of the cartons are formed by pre- breaking, folding and heat-and-pressure sealing. Then the bottom-closed cartons are advanced by an indexing, linear conveyor through pre-breaking, filling, folding and heat-and-pressure sealing stations to form filled and sealed, gable-top cartons with a top sealing fin. The cartons may or may not be brought to a flat-top form by tacking-down the sealing fin. The top end closure comprises four substantially rectangular panels of which two provide roof panels and of which the other two are sub-divided into three triangular panels which extend inwards to provide recessed gable ends, as well as providing the sealing fin. Score lines intermediate the four end closure panels and respective body panels and score lines among the triangular panels of each group of three triangular panels are pre-broken by folding inwards the four end closure panels. The four panels are still in that somewhat inwardly-folded condition when they arrive at the filling station, so the plan area available for filling purposes is less than immediately before pre-braking. Moreover in the direction of advance of the carton through the filling station, the internal dimension of the rim of the mouth of the carton and thus the time period between the earliest point in time at which filling can commence and the latest point in time at which filling can terminate are shortened relative to such carton immediately before pre-breaking. Moreover, if the open-topped carton is to be sterilized internally by spraying with liquid sterilant and then dried by sterile hot air, it is advantageous for reasons of access to the interior of the carton by the sterilant and the hot air if the sterilization and drying are performed prior to prebreaking, but then the insertion into the carton of a center-post of a known pre-breaker runs the risk of recontamination of the carton interior. Furthermore, if the filled carton is to be heat-and pressure-sealed by applying hot air to selected zones of the thermoplastics internal surfaces (and possibly of the thermoplastics external surfaces) of the top end closure panels to render those zones tacky and then folding the panels inwards and clamping them together between sealing jaws, it is difficult to render tacky the acute-angled, internal, very corners among the panels because the acute-angled form of those corners militates against easy access by the hot air.

DISCLOSURE OF THE INVENTION

A general object of the invention is to provide an improved breaker mechanism for use on a carton forming, filling, and sealing machine.

Another object of the invention is to provide a score line breaker mechanism which does not include a center-post, or any components which extend into the inside of a carton end closure, eliminating any chance of their introducing contamination into inside the end panels.

A further object of the invention is to provide a center-post-free breaker mechanism including three forming blades operative against the external surface of an interconnected four-sided carton end closure.

Still another object of the invention is to provide a center-post-free breaker mechanism including a first blade having arcuate center sections for caving in the adjacent end panel and, thereby, bulging the side end panels and pulling in the oppositely disposed panel, and a blade fork and another blade, wherein the blade fork includes two longitudinal, parallel extensions which slide across the side panels, and the other blade is a flat-faced bar for engaging the adjacent end panel and causing the side end panels to project outwardly, completing the pre-breaking of all vertical end closure score lines.

A yet further object of the invention is to provide a method and apparatus in which the filling time of an open-topped, bottom-closed carton can be reduced.

An even further object of the invention is to provide a method and apparatus in which the efficacy of heating of the corners of a plastics internal surface of an end closure of a carton can be improved.

An even yet further object of the invention is to provide a method and apparatus wherein opposite panels of a closed loop of panels of a carton end closure can be displaced outwards away from each other without any need to contact the internal surface of the end closure.

These and other objects and advantages will become more apparent when reference is made to the following drawings and accompanying description.

BEST MODE FOR CARRYING OUT THE INVENTION

Figure 1:
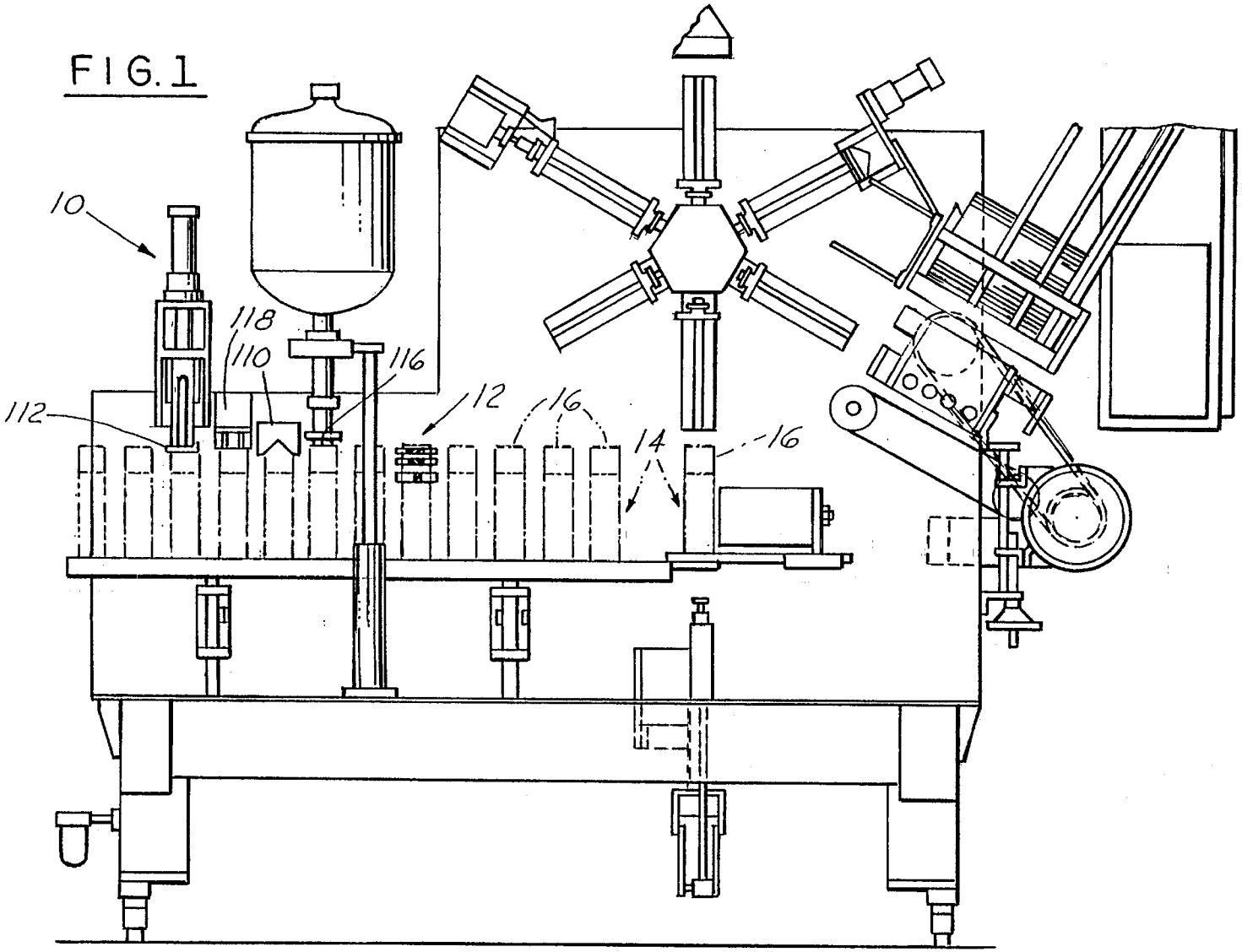
FIG. 1 is a side elevational view of a forming, filling, and sealing machine embodying the invention.
Figure 6:
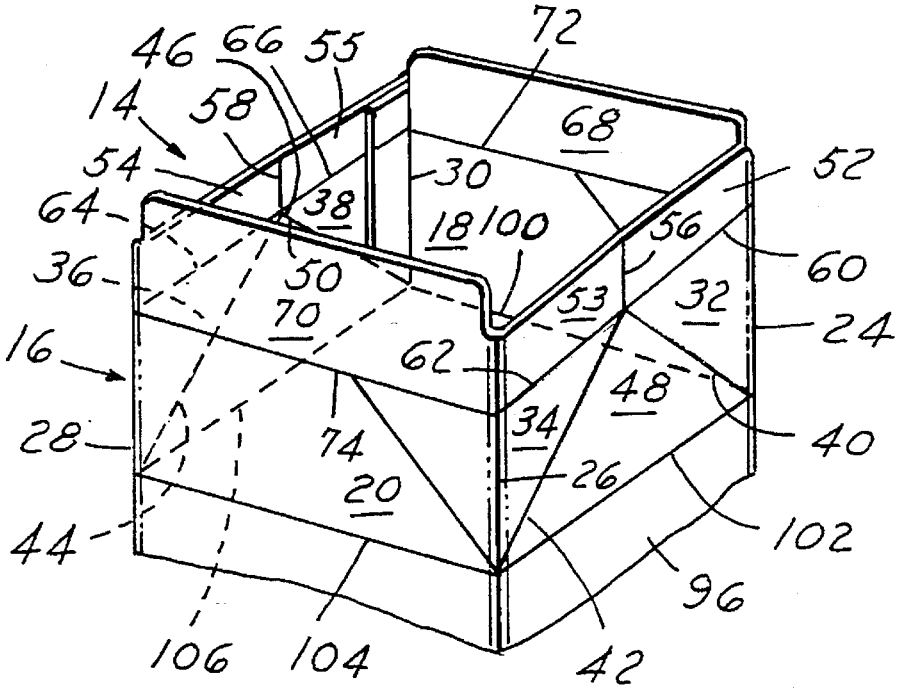
FIG. 6 is a fragmentary perspective view of a carton end closure in its fully open condition prior to being pre-broken.
Figure 7:
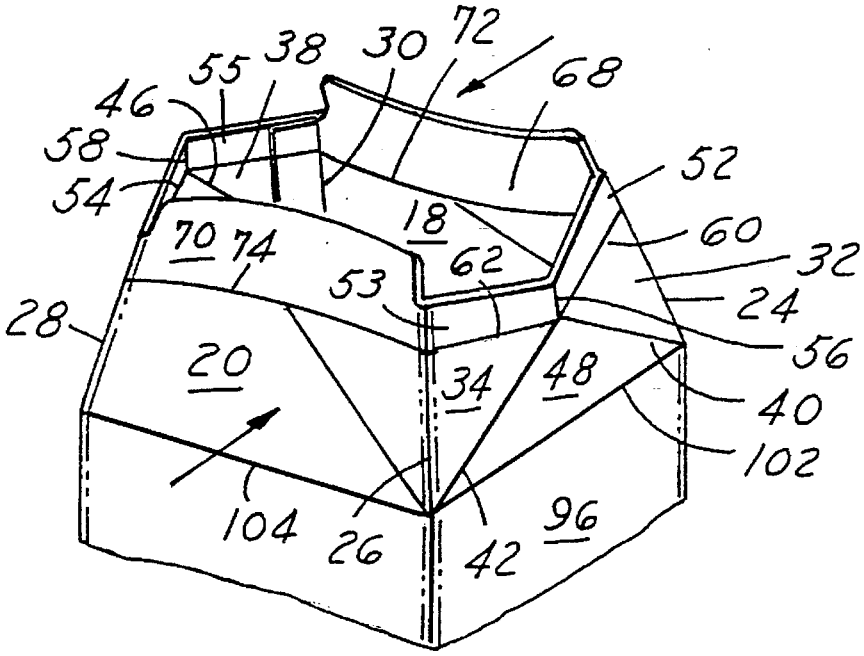
FIG. 7 is a fragmentary perspective view of the FIG. 6 carton after the pre-breaking operations have been performed.

Referring now to the drawings in greater detail, FIG. 1 illustrates a carton forming, liquid filling, and sealing machine 10 on which a center-post-free top closure breaker mechanism 12 is utilized for breaking the top closure score lines of a paperboard carton 14. Typically, and referring to FIG. 6, the carton 14 includes a top end closure 16 consisting of oppositely disposed outer rectangular panels 18 and 20 connected by vertical score lines 24, 26, 28, and 30 to inner triangular panels 32, 34, 36 and 38, which, in turn, are connected by diagonal score lines 40, 42, 44 and 46 to central triangular panels 48 and 50. Top seal panels 52, 53, 54 and 55 are connected to each other by vertical score lines 56 and 58, and by horizontal score lines 60, 62, 64, and 66 to the respective triangular panels 32, 34, 36, and 38, while top seal panels 68 and 70 are connected by horizontal score lines 72 and 74 to the respective panels 18 and 20.

The top closure breaker mechanism 12 includes a pair of identical, panel-bulging blade members of which one is indicated at 76 in FIGS. 2 and 2A, and 3 and 3A. The member 76 had an elongate front part shaped to have a central arcuate forward surface 78, with lugs 80 and 82 extending forwardly at a predetermined angle from the respective ends 84 and 86 of the arcuate surface 78.

Figure 2:
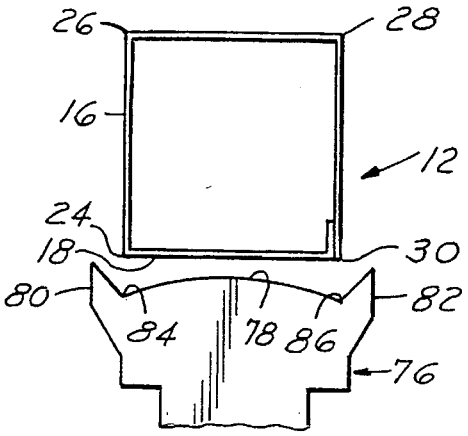
FIG. 2 is a top view of one of an identical pair of oppositely disposed panel-bulging blades embodied in the invention and in one operational condition.
Figure 2A:
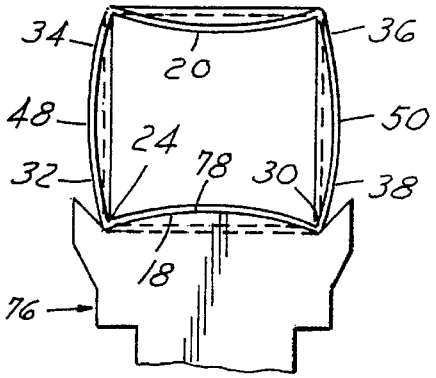
FIG. 2A is a top view similar to FIG. 2, in a different operational condition.
Figure 3:
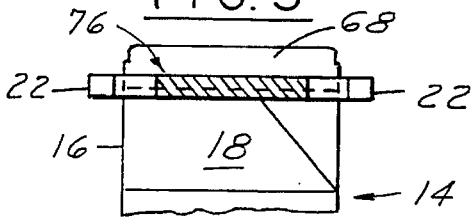
FIG. 3 is a sectional side elevational view of the FIG. 2 structure.
Figure 3A:
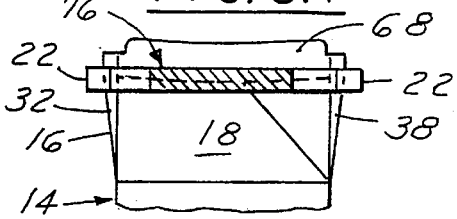
FIG. 3A is a sectional side elevational view of the FIG. 2A structure.
Figure 4:
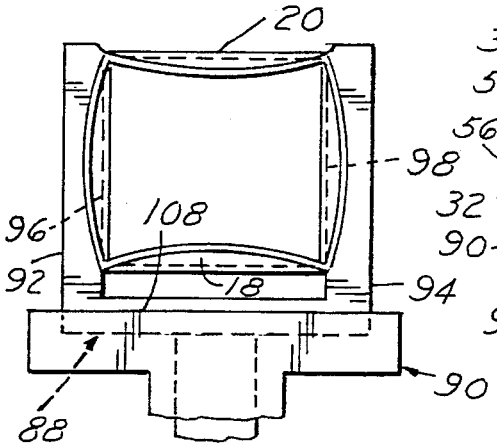
FIG. 4 is a top view of one pair of identical panel-restraining blades and one of a pair of identical panel-turning blades of a set of two additional pairs of oppositely disposed blades in one operational condition.
Figure 4A:
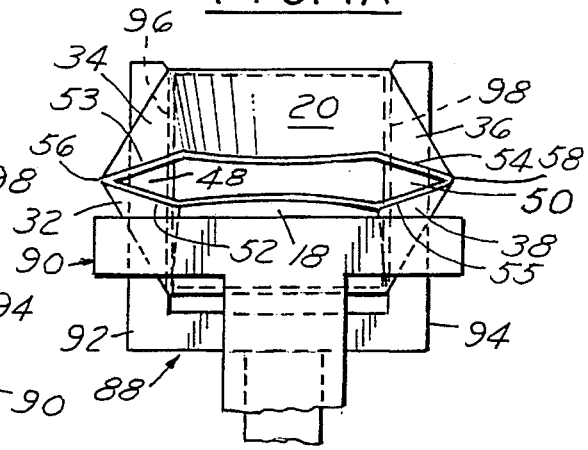
FIG. 4A is a top view similar to FIG. 4, in a different operational condition.
Figure 5:
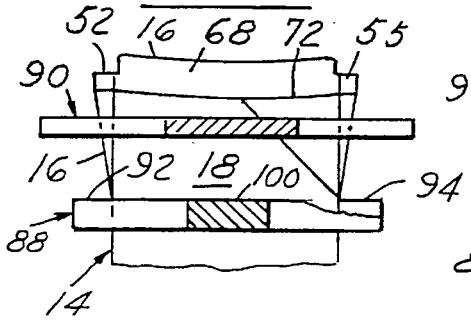
FIG. 5 is a sectional side elevational view of the FIG. 4 structure.
Figure 5A:
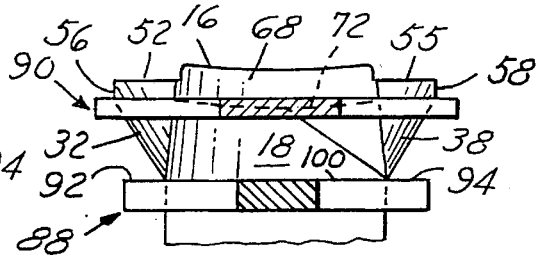
FIG. 5A is a sectional side elevational view of the FIG. 4A structure.

In operation, the arcuate surface 78 is moved into engagement with the adjacent top closure panel 18, (FIG. 2). This engagement causes the panel 18 to assume a concave shape (FIG. 2A), while oppositely disposed closure inner panels 32, 34, 38, 48 and 50 are initially caused to bulge outwardly to assume outwardly convex shapes (FIG. 2A). The inner edges of the lugs 80 and 82 converge towards the convex edge 78 and thereby centre the panel 18 relative to the edge 78 during bulging. The identical blade opposite the blade 76 simultaneously performs an identical bulging operation upon the panel 20 to cause the panel to bulge inwardly into a concave shape (FIG. 2A).

For use at the same station along the machine 10, a panel-restraining blade fork 88 and pair of panel-turning blade members (of which one is shown and referenced 90) co-act as follows:

The fork 88 consists of two longitudinal parallel members 92 and 94 which are moved horizontally forwardly to slide across and bear against oppositely disposed side body panels, identified as panels 96 and 98 in FIGS. 4, 4A, 5 and 5A. This action supports the four top body horizontal score lines identified as 100, 102 104 and 106 while the panel-turning blade member 90 and the opposite panel-turning blade member (not shown) which are shaped as respective flat-faced bars (of which one is shown and referenced 108), are moved horizontally inwardly towards the respective panels 18 and 20 in FIG. 4 to engage the top closure panels 18 and 20 and urge same inwardly, causing the oppositely disposed top closure panels 22, 34, 36, 38, 48 and 50 to project further outwardly, thus pre-breaking the oppositely disposed vertical top seal score lines 56 and 58, the horizontal score lines 60, 62, 64 and 66, and the two sets of oppositely disposed diagonal score lines 40, 42, 46 and 48, and the horizontal score lines 72 and 74.

Upon retraction of the panel-bulging blade members 76 the panel-restraining blade fork 88 and the panel-turning blade members 90, all the top closure score lines will have been pre-broken, thus being in condition to facilitate the folding operations at stations represented as 110 and 112, about the respective score lines after the individual cartons 14 proceed past the usual liquid filling station, represented as 116. At the station 112 the top end closure is pressure-sealed, after having been heated by hot air at the usual heating station, represented at 118. An advantage of using the inherent property of the open end closure that the panels 32, 34, 48 and 36, 38, 50 bulge outwards if one or both of the panels 18 and 20 is bulged inwards is that there is no need to insert any member into the mouth of the carton, so avoiding any risk of contamination of the interior of the carton by such insertion. At the station 116, which is the station, along the row of stations, requiring the longest dwell period, the advantage of having the groups of triangular panels 32, 34 and 48 and 36f 38 and 50 outwardly pre-broken is that the greater dimension of the carton mouth (compared with those triangular panels being inwardly pre-broken) enables the filling period to be commenced earlier and finished later and thus the dwell period at the filling station 116 to be reduced. Another advantage is that, if the heating station 118 were to precede the folding inwards of the groups of triangular panels, the hot air would be better able to penetrate into the corners of the mouth of the carton.

INDUSTRIAL APPLICABILITY

It should be apparent that the invention provides a carton end closure pre-breaker mechanism that is simple in construction, and efficient in operation, while eliminating the possibility of contamination within the end closure.

It should be further apparent that the prebreaking blade members may be mounted at two successive stations, rather than at the one station 12 shown in FIG. 1. For example, the pair of panel-bulging blade members 76 may be mounted at a first station, and the pairs of panel-restraining and panel-turning blade members 92, 94 and 90 at the next-in-line station. It should be still further apparent that the blade members 92, 94 and 90 could be vertically interconnected.

A single panel-bulging blade member 76 is usable instead of a pair, but a pair gives a more symmetrical and reliable outward bulging of the panels 32, 34, 48 and 36, 38, 50.

While but one embodiment of the invention has been shown and described, other modifications thereof are possible within the scope of the following claims

What is claimed is:

1. A method of forming a carton end closure having a loop of first, second, third and fourth closure panels connected by primary lines of weakness to one another and to first, second, third and fourth carton body panels, the first and third closure panels each including secondary lines of weakness, comprising pre-breaking the primary and secondary lines of weaknesses, the pre-breaking including displacement of said first and third closure panels outwardly away from each other, and subsequently folding the said first and third closure panels towards one another, the folding including displacement of said first and third closure panels inwardly towards each other between said second and fourth closure panels prior to any sealing of the end closure and fourth closure panels toward each other to seal them together wherein such displacement of said first and third closure panels outwardly away from each other is produced by pressing inwardly upon an external surface of at least said second closure panel of said second and fourth closure panels to cause at least said second closure panel of said second and fourth closure panels to bulge inwards and thus said first and third closure panels to bulge outwards away from each other.

2. A method according to claim 1, wherein further such displacement of said first and third closure panels outwardly away from each other is produced by further pressing inwardly upon the external surface of at least said second closure panel of said second and fourth closure panels to cause at least said second closure panel of said second and fourth closure panels to turn inwards and thus said first and third closure panels to turn outwards away from each other.

3. A method according to claim 1, wherein the bulging inwards of at least said second closure panel is produced by pressing inwardly upon the external surface of at least said second closure panel of said second and fourth closure panels with a convex edge of at least one elongate part extending transversely of the closure panels.

4. A method according to claim 3, wherein the bulging inwards of at least said second closure panel is accompanied by centering of at least the bulged second panel relative to such convex edge.

5. A method according to claim 2, wherein the turning inwards of at least said second closure panel is produced by pressing inwardly upon the external surface of at least said second closure panel of said second and fourth closure panels with a linear edge of at least one elongate part extending transversely of the closure panels.

6. A method according to claim 1 and further comprising, during said displacement of said first and third closure panels outwardly away from each other, restraining respective portions of said first and third body panels adjacent said first and third closure panels from moving outwards away from each other.

7. A method according to claim 5, wherein the restraining of said respective portions of said first and third body panels is performed by respective elongate parts bearing against the respective external surfaces of said respective portions of said first and third body panels and extending transversely of the body panels.

8. Apparatus for forming a carton end closure having a loop of first, second, third and fourth closure panels connected by primary lines of weakness to one another and to first, second, third and fourth carton body panels, the first and third closure panels each including secondary lines of weakness, the apparatus comprising pre-breaking means arranged to pre-break the primary and secondary lines of weaknesses and simultaneously to displace the first and third closure panels outwardly away from each other, and folding means arranged to fold the said first and third closure panels towards one another including to displace said first and third closure panels inwardly towards each other between said second and fourth closure panels prior to sealing the end closure, and pressing said second and fourth closure panels toward each other to seal them together wherein said pre-breaking means comprises pressing means serving to press inwardly upon a middle portion of an external surface of at least said second closure panel of said second and fourth closure panels to cause at least said second closure panel of said second and fourth closure panels to bulge inwards and thus said first and third closure panels to bulge outward.

9. Apparatus according to claim 8, wherein said pre-breaking means comprises further pressing means serving to press inwardly upon the external surface of at least said second closure panel of said second and fourth closure panels to cause at least said second closure panel of said second and fourth closure panels to turn inwards from the inwardly bulged condition and thus said first and third closure panels to turn outwards away from each other from the outwardly bulged condition.

10. Apparatus according to claim 8, wherein said pre-breaking means comprises a convex edge of at least one elongate part arranged to extend transversely of the closure panels.

11. Apparatus according to claim 10, and further comprising centering projections protruding from respective opposite end zones of said convex edge and having respective edges converging towards said convex edge for centering of at least the bulged second panel relative to such convex edge.

12. Apparatus according to claim 9, wherein said further pressing means comprises a linear edge of at least one elongate part arranged to extend transversely of the closure panels.

13. Apparatus according to claim 8, and further comprising restraining means arranged to restrain respective portions of the first and third body panels adjacent the first and third closure panels from moving outwards away from each other.

14. Apparatus according to claim 13, wherein said restraining means comprises respective elongate parts arranged to extend transversely of the body panels.

15. A method of causing two oppositely disposed carton panels of a loop of carton panels to displace outwardly away from each other, comprising pressing inwardly upon a middle portion of an external surface of at least one further panel of said loop intermediate said two oppositely disposed panels to cause said at least one further panel to bulge inwards and thus said two oppositely disposed panels to bulge outwards away from each other, wherein the bulging inwards of said at least one further panel is produced by pressing inwardly upon the middle portion of the external surface of said at least one further panel with a convex edge of at least one elongate member extending transversely of the panels and subsequently folding inwardly said two oppositely disposed panels that bulge outwardly between said at least one further panel and said loop.

16. a method according to claim 15, wherein the bulging inwards of said at least one further panel is accomplished by centering of such bulged further panel relative to such convex edge.

17. a method according to claim 15, wherein the bulging inwards of said at least one further panel is produced by pressing inwards upon the respective middle portions of the respective external surfaces of first and second further panels with respective convex edges of respective first and second elongate parts extending transversely of the panels.

18. The method described in claim 17, and with any insertion within said loop of carton panels not being required, to thereby eliminate the possibility of contamination from an insertion within said loop.

19. The apparatus described in claim 8, and said pre-breaking means being only outside said loop of first, second, third and fourth closure panels, to thereby eliminate the possibility of contamination from an insertion within said loop.

* * * * *

UNITED STATES PATENT AND TRADEMARK OFFICE

CERTIFICATE OF CORRECTION

PATENT NO. : 5,605,030
DATED : February 25, 1997
INVENTOR(S) : Frank A. Rodocker It is certified that error appears in the above-indentified patent and that said Letters Patent is hereby corrected as shown below:

Column 4, line 12, delete "36f" and insert --36,--.

Column 4, line 56, before "fourth" insert --pressing said second and--.
Column 4, line 57, after "together" insert --,--.

Signed and Sealed this

Twenty-sixth Day of August, 1997

*Attest:*

Bruce Lehman

BRUCE LEHMAN

*Attesting Officer*

*Commissioner of Patents and Trademarks*